US005329777A

United States Patent [19]

Weltmer, Jr.

[11] Patent Number: 5,329,777

[45] Date of Patent: Jul. 19, 1994

[54] CRYOGENIC STORAGE AND DELIVERY METHOD AND APPARATUS

[75] Inventor: William R. Weltmer, Jr., Murray Hill, N.J.

[73] Assignee: The BOC Group, Inc., Murray Hill, N.J.

[21] Appl. No.: 83,125

[22] Filed: Jun. 24, 1993

[51] Int. Cl.[5] ..... F17C 13/02

[52] U.S. Cl. ..... 62/49.2; 62/50.2

[58] Field of Search ..... 62/49.2, 50.2

[56] References Cited

U.S. PATENT DOCUMENTS

| | | | |
|---|---|---|---|
| 2,037,673 | 4/1936 | Zenner . | |
| 2,089,558 | 8/1937 | Karwat . | |
| 2,219,673 | 10/1940 | Zenner . | |
| 2,257,897 | 10/1941 | Zenner et al. | 62/50.1 |
| 2,479,070 | 8/1949 | Hansen . | |
| 2,502,184 | 3/1950 | Thayer . | |
| 3,003,007 | 10/1961 | Newsome, Jr. . | |
| 3,392,537 | 7/1968 | Woerner . | |
| 3,633,372 | 1/1972 | Kimmel et al. | 62/50.1 |
| 3,798,918 | 3/1974 | Maher et al. . | |
| 4,321,796 | 3/1982 | Kohno | 62/50.2 |
| 4,579,566 | 4/1986 | Brugerolle . | |
| 4,668,488 | 5/1987 | Ranke et al. . | |
| 4,727,723 | 3/1988 | Durr . | |
| 5,127,230 | 7/1992 | Neeser et al. . | |
| 5,144,806 | 9/1992 | Frenzel et al. . | |
| 5,148,681 | 9/1992 | Lagache . | |

*Primary Examiner*—Ronald C. Capossela

*Attorney, Agent, or Firm*—David M. Rosenblum; Larry R. Cassett

[57] ABSTRACT

A method and apparatus for delivering a cryogen in which a cryogen is stored and delivered in a cryogenic storage facility having three tanks. Each of the tanks is filled with the cryogen in a subcooled liquid state to wash contaminants down toward a bottom region thereof. Thereafter, a minor stream composed of superheated vapor is introduced into the bottom region of each tank to pressurize each tank. A major stream of the superheated vapor is then introduced into each tank to form scrubbed cryogenic vapor in the head space region thereof which is used in forming the product stream. Each tank is subsequently used to dispense the cryogen to a vaporizer to form the superheated vapor which is in turn divided into the major and subsidiary streams. The forgoing operations are preferably conducted the three tanks as an out of phase cycle such that one tank dispenses the liquid cryogen to the remaining tanks as the major and subsidiary streams and after having dispensed the cryogen, each tank is refilled which again substantially clears the top head space region thereof of contaminants.

11 Claims, 1 Drawing Sheet

CRYOGENIC STORAGE AND DELIVERY METHOD AND APPARATUS

BACKGROUND

The present invention relates to a cryogenic storage and delivery apparatus and method in which three tanks are used to store a cryogen as a pressurized, saturated liquid, to dispense the cryogen as a vapor by vaporizing the cryogen from the bottom region of one tank and introducing the vaporized cryogen into the bottom region of another tank, thereby to produce scrubbed cryogenic vapor in the top head space region of such tank, and to form a product stream substantially free of contaminants from the scrubbed cryogenic vapor. The utilization of the three tanks takes place in an out of phase cycle designed such that the top head space region of each tank is maintained substantially clear of contaminants.

Liquid cryogen is stored in cryogenic storage facilities consisting of one or more tanks from which the cryogen is delivered from each tank upon demand. Associated with a tank is a pressure building circuit to build the pressure within the tank to a delivery pressure and a heat exchanger, attached to an outlet of the tank, to supply the product at ambient temperature.

The cryogen is delivered from the tank at a delivery pressure. Hence, when a tank is filled, it is necessary to maintain the delivery pressure. This is accomplished by alternately filling the tank from top and bottom inlets in the top and bottom regions of the tank. This creates a problem due to the fact that higher boiling contaminants such as moisture solidify on the walls of the tank and airborne dust drawn in during the filling of the tank also is deposited on the walls of the tank. Thus, after a filling of the tank, the product is initially delivered with a high concentration of the contaminants. This problem is exacerbated due to the pressure building circuit which draws off cryogen from the bottom of the tank and returns cryogenic vapor along with contaminants to the top region of the tank, the region where the cryogen is delivered. In order to solve the contaminant problem it has been known to employ either a tank within a tank or two tanks in which cryogenic vapor from one tank is bubbled through the bottom of another tank in order to solidify the contaminants prior to delivery of a cryogenic liquid or to purify cryogenic vapor prior to delivery. See for instance, U.S. Pat. No. 3,798,918 and U.S. Pat. No. 4,579,566.

Another problem involved in the storage and delivery of the cryogen is that the physical properties of the cryogen are not uniform. The reason for such non-uniformity is that the cryogen is initially delivered from a tank truck in which the cryogen is stored at a much lower pressure than the intended delivery pressure. As the tank is alternately filled from the top and bottom inlets, the cryogen when entering from the top of the tank becomes saturated while the cryogen entering from the bottom of tank subcools due to the exertion of the increased tank pressure. The end result is a top strata of saturated liquid and an underlying layer of subcooled liquid is formed. The properties of the cryogen vary with such strata and hence, the cryogen is delivered with non-uniform properties over time. The varying properties are exasperated by the continuing use of the normal pressure building methods.

As will be discussed, the present invention provides a cryogenic delivery method and apparatus for delivering a product stream composed of stable, saturated cryogen substantially free of contaminants.

SUMMARY OF THE INVENTION

The present invention provides a method of storing and delivering a cryogen which comprises an initial step (a) of storing the cryogen within a tank of a cryogenic storage facility having at least two tanks. Step (a) is effectuated by filling the tank with the cryogen as a saturated liquid such that the cryogen is introduced into the tank through a top head space region of the tank to wash the contaminants down toward a bottom region of the tank. This "washing down" thereby substantially clears the top head space region of the tank of the contaminants. In accordance with a step (b), the tank is pressurized without contaminating the top head space region thereof and without converting the saturated liquid into a subcooled liquid by introducing a subsidiary superheated vapor stream into the bottom region thereof. In a step (c), a major superheated vapor stream is introduced into the bottom region of the tank to scrub the superheated vapor stream with the saturated liquid contained within the tank. The scrubbing forms scrubbed cryogenic vapor in the top head space region of the tank. A product stream is withdrawn from the top head space region of the tank. The product stream is formed from scrubbed cryogenic vapor and is thereby substantially free of the contaminants. In a step (e), a stream of the cryogen is dispensed from the tank. This is accomplished by pressure building the tank with a pressure building circuit connecting the top head space and bottom regions thereof. Pressure building in this manner, however, contaminates the top head space region with the contaminants previously washed down to the bottom region during step (a). The result of the pressure building is that a stream of the cryogen is expelled from the bottom region of the first tank. The stream of the cryogen is vaporized in a step (e) to form superheated vapor and subsidiary and major streams are formed from the superheated vapor in steps (f) and (g). In a step (h), steps (a) through (g) are continuously performed on the tank and at least one remaining tank in an out of phase cycle such that the major superheated vapor stream introduced into the at least one remaining tank during the performance of step (c) thereon comprises the major stream formed during performance of step (g) on the tank.

The performance of the steps in such out of phase cycle ensures that the head space region of the tank and the one remaining tank are substantially clear of the contaminants during successive performance of step (c) thereon. More specifically, the top head space region of each tank are cleared of contaminants during filling, the tanks are pressurized without contaminating the top head space region of each tank, the tanks are then used to scrub contaminated superheated vapor drawn from the bottom region of another tank to produce the product stream. Thereafter, the head space region of each tank is contaminated when the tank serves to initiate creation of the superheated vapor due to the use of a pressure building circuit. However, the tank is thereafter cleared when the tank is refilled.

The method can be practice on a minimum of two tanks. In such case the subsidiary superheated vapor stream introduced into the tank and the at least one remaining tank during respective performance of step (b) thereon respectively comprises the subsidiary stream produced during performance of step (f) on the at least one remaining tank and then on the tank. The disadvantage of this is that while a tank is being pressurized through introduction of the subsidiary stream there is an interruption in service. In order to avoid this, the method of the present invention is preferably practiced with three tanks. In such case, the tank and the at least one remaining tank comprise first and third tanks of the three tanks. Steps (f) and (g) are performed simultaneously by dividing the superheated vapor into the major and subsidiary streams and steps (a) through (g) are continuously repeated on the first tank, a second of the three tanks and the third tank in the out of phase cycle. In such cycle, the major superheated vapor stream introduced into the first, second, and third tank during the respective performance of step (c) thereon respectively comprises the major stream formed during performance of step (g) on the second tank, step (g) on the third tank, and step (g) on the first tank. The subsidiary superheated vapor stream introduced into the first, second, and third tank during the respective performance of step (b) thereon comprises the subsidiary stream formed during performance of step (f) on the third tank, step (f) on the first tank, and step (f) on the second tank.

In another aspect, the present invention provides an apparatus for storing and delivering a cryogen. The apparatus comprises a cryogenic storage facility having three tanks. Each of the tanks has a top head space region and a bottom region located opposite to the top head space region. A filling means is provided for selectively filling each of the three tanks with the cryogen such that the cryogen washes contaminants from the head space region down towards the bottom region. A vaporization means is connected to the bottom region of each of the three tanks for selectively vaporizing a stream of the saturated liquid from each of the three tanks to thereby form superheated vapor which contains the contaminants washed down during the filling of each of the three tanks. A distribution means is provided for dividing the superheated vapor into subsidiary and major streams. The distribution means is also employed for selectively introducing the subsidiary stream into the bottom region of each of the three tanks after having been filled to convert the cryogen into a saturated liquid and to build pressure within each of the three tanks without contaminating the head space region thereof. Additionally, the distribution means also selectively introduces the major stream into the bottom region of each of the three tanks to scrub the impurities present within the major stream with the saturated liquid. A scrubbed saturated vapor is thereby formed in the top head space region. The distribution means is configured to divide the superheated vapor formed from the stream of the saturated liquid of a first of the three tanks one tank and to introduce the major and subsidiary streams into a second and a third of the three tanks, respectively. The distribution means is also configured to divide the superheated vapor formed from the stream of the saturated liquid of the second of the three tanks and to introduce the major and subsidiary streams into the first and third of the three tanks, respectively, and to divide superheated vapor formed from the stream of the saturated liquid of the third of the three tanks and to introduce the major and subsidiary streams into the second and first of the three tanks. A delivery means is provided for selectively delivering a product stream composed of scrubbed cryogenic vapor formed in the top head space region of each of the three tanks. A pressure building means is connected to the to head space and bottom regions of each of the three tanks for selectively building pressure in each of the three tanks in the head space regions thereof such that the stream of the liquid cryogen is expelled from the bottom region of each of the three tanks to the vaporization means.

Each tank after having been filled and pressurized is thereby operable for use in scrubbing saturated liquid and forming scrubbed cryogenic vapor in the head space region thereof. The head space region during delivery of the product stream is substantially cleared of contaminants during filling so that the product stream is also substantially free of the contaminants. The out of phase cycling of the tanks allows the product to be continuously delivered from the tanks.

BRIEF DESCRIPTION OF THE DRAWING

While the specification concludes with claims distinctly pointing out the subject matter that Applicant regards as his invention, it is believed that the invention will be better understood when taken in connection with the accompanying drawings in which the sole FIGURE is a schematic representation of an apparatus in accordance with the present invention.

DETAILED DESCRIPTION

Figure 1:
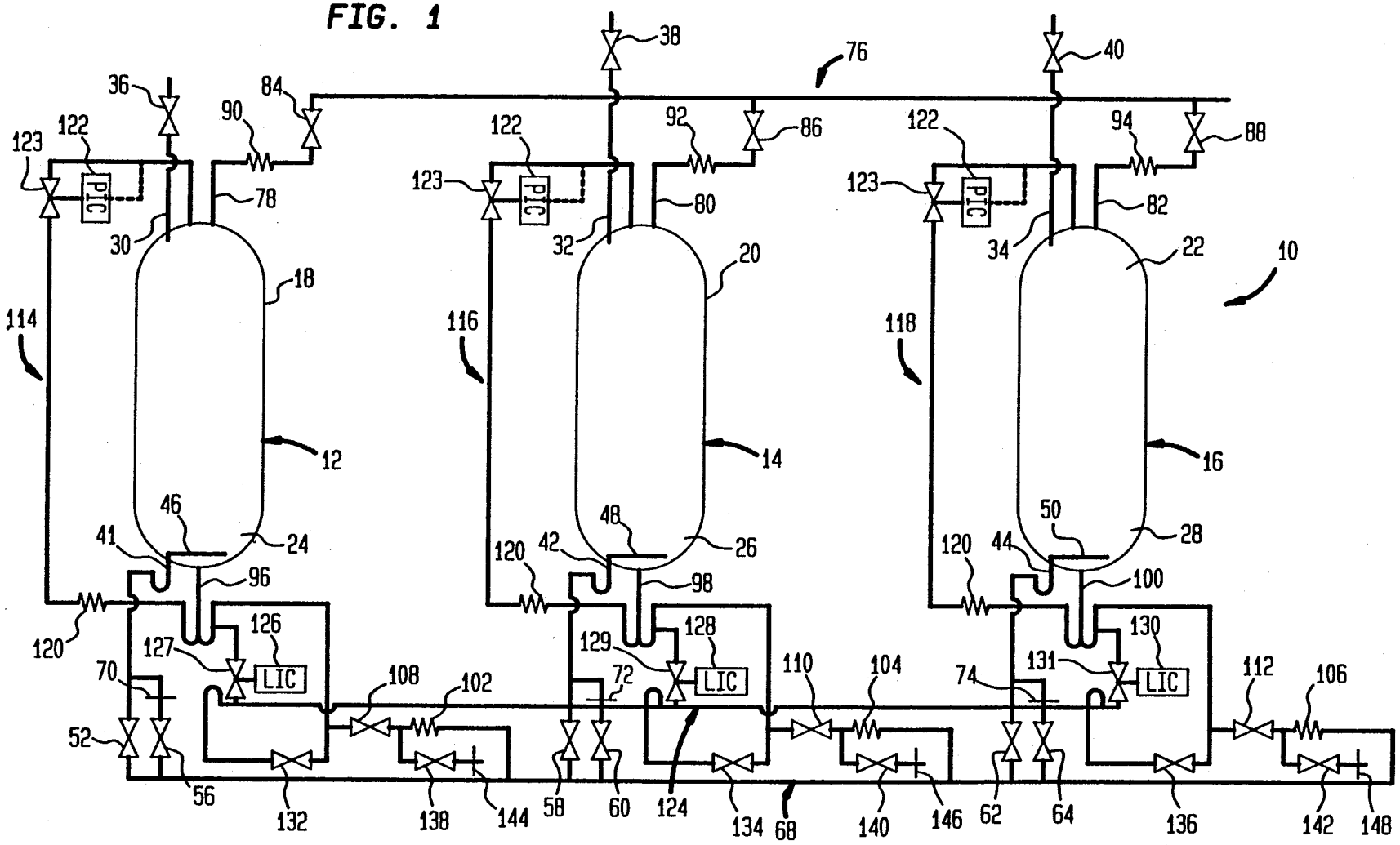

With reference to the FIGURE, a cryogenic storage facility 10 is illustrated for storing and delivering a cryogen in accordance with the present invention. As used herein and in the claims the term "cryogen" means any low boiling volatile substance such as liquefied atmospheric or natural gases.

Cryogenic storage facility 10 comprises three tanks, namely a first tank 12, a second tank 14, and a third tank 16 designed in a manner well known in the art as conventional storage facility tanks. As illustrated, first, second, and third tanks 12–16 have top head space regions 18, 20, and 22 and bottom regions 24, 26, and 28. Although only three tanks are illustrated, it is possible to have multiple tanks with only three of the tanks required at any one time being operated in accordance with the discussion hereinafter set forth.

First, second, and third tanks 12–16 are utilized in an out of phase cycle to store the cryogen as a saturated liquid having uniform properties and then to deliver a product stream composed of scrubbed cryogenic vapor substantially free of contaminants such as moisture. During one phase of the cycle, first tank 12 and second tank 14 have been previously filled with the cryogen and third tank 16 is ready to be filled. Each of the first, second, and third tanks 12–16 are filled through top head space regions 18–22 to wash contaminants down towards bottom regions 24–28 thereof. Thus, when third tank 16 is filled, contaminants are washed down towards its bottom region 28. A stream of saturated liquid (rich in contaminants) is being withdrawn from bottom region 26 of second tank 14 and is being vaporized to form superheated vapor. Major and subsidiary superheated vapor streams are formed by dividing the superheated vapor into major and subsidiary streams. The major stream is introduced into bottom region 24 of first tank 12 to scrub contaminants from the superheated vapor and to produce the scrubbed cryogenic vapor in top head space 18 of first tank 12. A product stream substantially free of the contaminants is removed from top head space 18, since top head space 18 has been cleared of contaminants during the filling of first tank 12. After third tank 16 is filled with the cryogen in a saturated liquid state, the subsidiary stream is introduced into bottom region 28 of third tank 16 to pressurize third tank 16 with the pressure driving the subsidiary stream into third tank 16. Since the subsidiary stream is bubbling through the cryogen within third tank 16, there is no stratification of the type found in the prior art and the cryogen within third tank 16, or any other tank pressurized in such manner, will have uniform properties. The driving pressure is produced from the pressurization of second tank 14 by a pressure building circuit which builds pressure in top head space region 20 of second tank 14 at this phase of the cycle. In building pressure head space 20 becomes contaminated with contaminants present at bottom region 26 of second tank 14.

The foregoing can be summarized as second tank 14 serving in a dispensing mode, that is dispensing saturated liquid to tanks 12 and 16, first tank 12 serving in a scrubbing/delivery mode, namely scrubbing cryogen vaporized to a superheated state but dispensed from second tank 14 while delivering the product stream composed of scrubbed cryogenic vapor, and third tank 16 serving in a filling/pressurization mode in which third tank 16 is filled, the cryogen is converted into a saturated liquid, and third tank 16 is pressurized. During this phase of the cycle, top head space region 20 of second tank 14 is becoming contaminated with the contaminants, top head space region 18 of first tank 12 is clear of contaminants, and top head space region 22 of third tank 16 is being cleared of contaminants during its service in the filling mode.

The emptying of second tank 14 triggers the next phase of the cycle. In the next phase first tank 12 serves in the dispensing mode, second tank 14 the filling/pressurization mode, and third tank 16 serves in the scrubbing mode. The filling of second tank 14 with the cryogen washes contaminants from its head space region 20 down towards its bottom region 26, thus clearing top head space region 20 of the contaminants. Subsequently, first tank 12 empties and second tank 14 serves in the scrubbing/delivery mode and third tank 16 serves in the dispensing mode. Tank 12 is then refilled with the cryogen to wash impurities from its top head space region 18 down towards its bottom region 24. The cycle repeats so that scrubbed cryogenic vapor is continuously being delivered from a tank having a top head space previously cleared of contaminants.

In an alternate mode, only two tanks could be used at any one time. In such case, tanks 12 and 16 would each sequentially serve in filling/pressurization, scrubbing-/delivery, and dispensing modes of operation. However, the subsidiary stream used in pressurizing tank 12 would be derived from superheated vapor generated from cryogen contained within tank 16 and thereafter, the major stream to be scrubbed in tank 12 would then derive from superheated vapor generated from cryogen contained in tank 16. Thus, major and subsidiary streams would be sequentially generated rather than being simultaneously generated through division. Tank 16 would be pressurized and serve in a scrubbing/delivery mode of operation through introduction of subsidiary and major streams derived from cryogen withdrawn from tank 12. The disadvantage of such a mode of operation is that in an industrial application of the invention, the cryogenic storage facility would be out of service for one-half a day or more filling and pressurizing a tank.

Having generally described the operation of cryogenic storage facility 10, a more detailed description begins with a description of tanks 12, 14, and 16. Each of the tanks 12, 14 and 16 is provided with a top inlet 30, 32 and 34. Valves 36, 38, and 40 are provided for opening and closing top inlets 30–34. It is to be noted that the top inlets 30–34 are provided in top head space regions 18–22 of first, second, and third tanks 12–16. Practically speaking, the term "top head space" as used herein and in the claims is a top region of the tank which will contain scrubbed cryogenic vapor. As such, when each of the first, second, and third tanks 12–16 is being filled, valve 36 is open for first tank 12, valve 38 is open for second tank 14 and valve 40 is open for third tank 16. The incoming cryogen washes incoming contaminants in a downward direction and towards bottom region 24 of first tank 12, bottom region 26 of second tank 14 and bottom region 28 of third tank 16. Thus, top head space regions 18, 20 and 22 are substantially cleared of contaminants during the filling operation. As will be discussed, they are maintained substantially clear of contaminants during accumulation of product.

After a tank (any of first, second, and third tanks 12–16) has been filled, a respective valve for each tank closes (valves 36, 38 and 40) and the tank is pressurized. To this end, first, second, and third tanks 12–16 are provided with bottom inlets 41, 42, and 44. A subsidiary vapor stream (composed of superheated vapor and formed in the manner as will be described hereinafter) is introduced into bottom regions 24–28 of first, second, and third tanks 12–16 through bottom inlets 41, 42, and 44 which are fed to bottom inlet manifolds 46–50. Bottom inlet manifolds are perforated tubes bent in a ring or horse shoe shape. The number and size of the perforations are designed in a manner well known in the art in order to allow the superheated vapor in the subsidiary stream to bubble through the cryogen contained within a tank. The introduction of the superheated vapor into the cryogen being stored in the tank pressurizes each of the first, second, and third tanks 12–16. Some of the superheated vapor within the subsidiary stream will condense upon its introduction to raise the level of cryogen within a tank. Therefore, each of the first, second, and third tanks 12–16 should initially be filled to a level below the intended operational level of cryogen to account for such condensation.

After having been pressurized, each of first, second, and third tanks 12–16 at the appropriate point in their cycle of use then serves in the scrubbing/delivery mode. To this end, a major stream is introduced into bottom inlets 41, 42, and 44 to thereby introduce superheated vapor into saturated liquid contained within the tank. Any contaminants present within the superheated vapor, such as moisture will freeze in the cryogenic liquid and other solid contaminants, such as dust will not be carried into the head space regions of the tanks. As a result, scrubbed cryogenic vapor substantially free of contaminants will collect in head space regions 18–22 of first, second, and third tanks 12–16.

In order to control whether the major or subsidiary stream is introduced into each of the first, second, and third tanks 12–16, two valves 52 and 56 for bottom inlet 41, valves 58 and 60 for bottom inlet 42, and valves 62 and 64 for bottom inlet 44 are provided. When valve 52 is open, the major stream is introduced into first tank 12. The same holds true when valve 58 is open for second tank 14; and valve 62 is open for tank 38. When a subsidiary stream is to be introduced into each of first, second, and third tanks 12–16, valves 56, 60 and 64 are opened as appropriate. As illustrated, valves 52–64 are attached to an underslung distributor pipe 68 through which the superheated vapor is introduced into first, second, and third tanks 12–16. The distribution of the superheated vapor into the major and subsidiary streams is controlled by valves 52 through 64 and orifice plates 70–74 used in conjunction with valves 56, 60 and 64. For instance, when valve 52 is open, a major stream flows into first tank 12 and when either valve 60 or 64 are open the subsidiary stream flows into tanks 14 and 16, respectively. The closing of valve 52 and the opening of valve 56 will cause the subsidiary stream to flow into first tank 12. Thus, valves 52–64 control the distribution of superheated vapor from distributor pipe 68.

A header pipe 76 is provided to deliver a product stream to the customer. The product stream consists of the scrubbed cryogenic vapor. First, second, and third tanks 12–16 are provided with top outlets 78–82 to discharge a scrubbed cryogenic vapor stream from top head space regions 18–22 of first, second, and third tanks 12–16. A set of three valves 84, 86 and 88 are interposed between header pipe 76 and top outlets 78–82 to control the source of the product stream. When, for instance, first tank 12 is in the scrubbing-/delivery mode, valve 84 is open; otherwise it is closed. The same holds true for valves 86 of second tank 14 and valve 88 of third tank 16.

An ambient heat exchanger is provided for each tank, to wit: ambient heat exchangers 90–94 located between top outlet 78 and valve 84; top outlet 80 and valve 86; and top outlet 82 and valve 88. The saturated vapor passing through such heat exchangers warms the scrubbed cryogenic vapor to ambient temperature and therefore, the product stream delivered through header pipe 76.

After having served in the scrubbing/delivery mode, each of the first, second, and third tanks 12–16 serve in a dispensing mode to dispense the cryogen. To this end, each of first, second, and third tanks 12–16 is respectively provided with a bottom outlet 96–100 through which a stream of saturated liquid can be withdrawn from each of first, second, and third tanks 12–16. Attached to bottom outlets 96, 98, 100 are vaporizers 102, 104 and 106. The stream of the cryogen removed is vaporized to form superheated vapor. In order to route cryogen liquid to vaporizers 102, 104 and 106, outlet valves 108, 110 and 112 are interposed between vaporizers 102, 104 and 106 and bottom outlets 96, 98 and 100, respectively. The foregoing vaporizers are attached to distributor pipe 68 for distribution as subsidiary and major streams to the remaining two tanks not being used in the dispensing mode.

In order to drive the major and subsidiary streams from tank to tank, conventional pressure building circuits 114, 116 and 118 are associated with the respective tanks 12, 14 and 16. Each pressure building circuit contains a vaporizer 120, a pressure indicator controller 122, and a valve 123 controlled by pressure indicator controller 122. When pressure indicator controller 122 is activated for any of tanks 12, 14 and 16, saturated liquid flows through the respective outlets 96, 98 and 100 into vaporizer 120. The resultant vapor is then fed into top head space regions 18, 20 and 22 of first, second, and third tanks 12–16 to pressurize the tanks. Valve 123 opens and closes upon command of pressure indicator controller 123 to maintain pressure at a set pressure.

Only a single pressure building circuit is activated at any one time. For instance, assuming that first tank 12 is the dispensing tank and second tank 14, the filling/-pressurization tank and tank 16, the scrubbing/delivery tank, pressure building circuit 114 would be activated and pressure indicator controller 122 associated with pressure building circuit 114 would control the pressure within first tank 12, for example 160 psig. At the same time, valve 108 would be open to permit a stream of cryogenic liquid from first tank 12 to flow through vaporizer 102 to be vaporized and to produce superheated vapor. Valves 52 and 56 would be closed, valve 60 would be open and valve 62 would be open. The end result would be that superheated vapor would flow into distributor pipe 68, a subsidiary stream would flow into second tank 14 (after having been filled) and a major vapor stream would flow into third tank 16. Tank 14 would thereby eventually be pressurized to about $\lesssim 1$ psig for eventual use as a scrubbing/delivery tank. During this time, however, third tank 16 would be serving in the scrubbing/delivery mode.

When second tank 14 serves in the scrubbing/delivery mode the major stream will originate from the third tank 16 and will be driven by pressure building third tank 16 to 160 psig. Since there are piping and valve induced pressure drops and second tank 14 has previously been pressurized to 155 psig, the major stream will not immediately flow into second tank 14, but rather, scrubbed cryogenic vapor will be delivered from second tank 14 (through top outlet 80 and header pipe 76) at an initial delivery pressure of 155 psig. This pressure will drop after a short time interval, for example to 150 psig, and the major stream will then flow into second tank 14. This foregoing operation will occur when any of the first, second, and third tanks 12–16 serves in the scrubbing/delivery mode.

During the scrubbing/delivery, the level of the cryogen in the scrubbing/delivery tank will tend to decrease. For this reason, a liquid distributor pipe 124 is connected to bottom outlets 96, 98 and 100 of first, second, and third tanks 12–16. Level indicator controllers 126, 128 and 130 are provided to sense the liquid level each of the first, second, and third tanks 12–16. When the liquid level drops below a predetermined point as sensed by such level indicator controllers, associated valves 127, 129, 131 are commanded to appropriately open to permit liquid to flow to the tank serving in the scrubbing/delivery mode. The liquid is supplied from a tank serving in the dispensing mode through the opening of valves 132, 134, 136 when such tank is to serve in the dispensing mode. For instance, if first tank 12 were in the dispensing mode and third tank 16 were in the scrubbing/delivery mode, and the liquid level dropped below the predetermined level within third tank 16 as sensed by level indicator controller 130, valve 131 would be commanded to an open position. Valve 132 would have previously been set in an open position upon the initiation of first tank 12 serving in the dispensing mode in order to permit liquid to flow from first tank 12 into third tank 16.

The start of another phase of the cycle is triggered by emptying of the particular one of first, second, and third tanks 12–16 which is currently serving in the dispensing mode. Specifically, when the level of liquid within a dispensing tank is not sufficient for pressurization purposes, the next phase of the cycle should be triggered. The low level of the cryogen can be sensed by level indicator controllers 126, 128, and 130. Alternatively, a pressure sensor associated with each of first, second, and third tanks 12–16 can be used to trigger the phases of the cycle.

Optionally, and as illustrated, each vaporizer 102, 104, 106, can have a respective vent valve/orifice plate combination formed by vent valves 138, 140, and 142 and by orifice plates 144, 146, and 148. The opening of each vent valve 138–146 permits a superheated vapor stream to back flow through a respective of the vaporizers 102–106 for cleaning purposes. Orifice plates 144–148 restrict the flow to a minor fraction of the saturated liquid being vaporized.

The operation of the valving associated with cryogenic storage facility 10 can be effected manually through a conventional control system designed in a manner well known in the art and all of the foregoing valves can therefore be remotely actuated air valves. As would occur to those skilled in the art, the operation of the valves could be automated by the control system being of the programmable logic type and with the further inclusion of appropriate controls and interlocks.

While the invention has been described in reference to preferred embodiment, it will be understood by those skilled in the art that numerous additions, changes and omissions may be made without departing from the spirit and the scope of the invention.

I claim:

1. A method of storing and delivering a cryogen substantially free of contaminants, said method comprising the steps of:

(a) storing the cryogen within a tank of a cryogenic storage facility having at least two tanks by filling the tank with the cryogen as a saturated liquid such that the cryogen is introduced into tank through a top head space region of the tank to wash the contaminants down towards a bottom region of the tank, thereby to substantially clear the top head space region of the contaminants;

(b) pressurizing the tank without contaminating the top head space region thereof and without converting the saturated liquid into a subcooled liquid by introducing a subsidiary superheated vapor stream into the bottom region thereof;

(c) introducing a major superheated vapor stream into the bottom region of the tank to scrub the superheated vapor stream with the saturated liquid contained within the tank, thereby to form scrubbed cryogenic vapor in the top head space region thereof while withdrawing a product stream from the top head space region of the tank formed from the scrubbed cryogenic vapor and thereby being substantially free of the contaminants;

(d) dispensing a stream of the cryogen from the tank by pressure building the tank with a pressure building circuit connecting the top head space and bottom regions thereof, thereby contaminating the top head space region with the contaminants previously washed down to the bottom region during step (a) while expelling the stream the cryogen from the bottom region thereof; and (e) vaporizing the stream of the cryogen to form superheated vapor;

(f) forming a subsidiary stream from the superheated vapor;

(g) forming a major stream from the superheated vapor; and (h) continuously performing steps (a) through (g) on the tank and at least one remaining tank in an out of phase cycle such that the major superheated vapor stream introduced into the at least one remaining tank during the performance of step (c) thereon comprises the major stream formed during performance of step (g) on the tank and the head space region of each of the tank and the one remaining tank are substantially clear of the contaminants during the successive performance of step (c) thereon.

2. The method of claim 1, wherein:

the subsidiary superheated vapor stream introduced into the tank and the at least one remaining tank during respective performance of step (b) thereon respectively comprises the subsidiary stream produced during performance of step (f) on the at least one remaining tank and then on the tank; and the major superheated vapor stream introduced into the tank comprises the major stream produced during performance of step (g) on the at least one remaining tank.

3. The method of claim 1, wherein:

the cryogenic storage facility comprises three tanks;

the tank and the at least one remaining tank comprise first and third tanks of the three tanks; and steps (f) and (g) are performed simultaneously by dividing the superheated vapor into the major and subsidiary streams;

steps (a) through (g) are continuously repeated on the first tank, a second of the three tanks and the third tank in the out of phase cycle such that such that the major superheated vapor stream introduced into the first, second, and third tank during the respective performance of step (c) thereon respectively comprises the major stream formed during performance of step (g) on the second tank, step (g) on the third tank, and step (g) on the first tank and the subsidiary superheated vapor stream introduced into the first, second, and third tank during the respective performance of step (b) thereon comprises the subsidiary stream formed during performance of step (f) on the third tank, step (f) on the first tank, and step (f) on the second tank.

4. The method of claims 1 or 2 or 3 further comprising warming the product stream to ambient temperature.

5. The method of claim 3, further comprising: maintaining the level of the liquid cryogen during the performance of step (c) on the first tank, by transferring a liquid cryogen stream composed of the saturated liquid from the bottom region of the second of the three tanks to the bottom region of the first tank; maintaining the level of the liquid cryogen during the performance of step (c) on the second of the three tanks by transferring the liquid cryogen stream from the bottom region of the first tank to the second of the three tanks; and maintaining the level of the liquid cryogen during the performance of step (c) on the third of the three tanks by transferring the liquid cryogen stream from the second to the third of the three tanks.

6. An apparatus for storing and delivering a cryogen substantially free of contaminants comprising:

a cryogenic storage facility comprising three tanks, each having a top head space region and a bottom region located opposite to the top head space region;

filling means for selectively filling each of the three tanks with the cryogen such that the cryogen washes the contaminants from the head space region down towards the bottom region;

vaporization means connected to the bottom region of each of the three tanks for selectively vaporizing a stream of saturated liquid from each of the three tanks to thereby form superheated vapor containing the contaminants washed down during the filling of each of the three tanks;

distribution means for dividing the superheated vapor into subsidiary and major streams, for selectively introducing the subsidiary stream into the bottom region of each of the tanks after having been filled to convert the cryogen into a saturated liquid and to build pressure within each of the three tanks without contaminating the head space region thereof and for selectively introducing the major stream into the bottom region of each of the three tanks to scrub the contaminants present within the major stream with the saturated liquid, thereby to form a scrubbed saturated vapor in the top head space region thereof, the distribution means configured to divide superheated vapor formed from the stream of saturated liquid of a first of the three tanks and to introduce the major and subsidiary streams into a second of the three tanks and a third of the three tanks, respectively, configured to divide superheated vapor formed from the stream of saturated liquid of the second of the three tanks and to introduce the major and subsidiary streams into the first and third of the three tanks, respectively, and configured to divide superheated vapor formed from the stream of the saturated liquid of the third of the three tanks and to introduce the major and subsidiary streams into the first and second of the three tanks, respectively;

delivery means for selectively delivering a product stream composed of scrubbed cryogenic vapor formed in the top head space region of each of the three tanks; and pressure building means connecting the top head space and bottom regions of each of the three tanks for selectively pressure building each of the three tanks such that the stream of the liquid cryogen is expelled from the bottom region of each of the three tanks to the vaporizer means, whereby each tank after having been filled and pressurized is operable for use in scrubbing saturated liquid after vaporiziation and forming scrubbed cryogenic vapor in the head space region thereof which has been substantially cleared of contaminants during filling so that the product stream is thereby substantially clear of contaminants.

7. The apparatus of claim 6, wherein the pressure building means comprises a pressure building circuit associated with each of the tanks, the pressure building circuit having a pressure indicator controller and a valve activated by the pressure indicator controller to control pressure level within each of the three tanks.

8. The apparatus of claim 6, further including means for replenishing loss of the saturated liquid within each of the three tanks when delivering the product stream therefrom with a liquid cryogen stream composed of the saturated liquid withdrawn along with stream of the saturated liquid to be vaporized.

9. The apparatus of claim 6, further comprising ambient temperature heat exchange means for warming the product stream to ambient temperature.

10. The apparatus of claim 6, wherein the distribution means comprises a distributor pipe connected to the vaporizer means a set of six valves including two valves for each of the first, second, and third of the three tanks connecting each of the three tanks to the distributor pipe, and a set of three orifices, each interposed between one of the two valves and each of the three tanks, whereby opening the one of the two valves causes introduction of the subsidiary stream and opening of the other of the two valves causes introduction of the major stream.

11. The apparatus of claim 10, wherein the vaporizer means comprises three vaporizers connected to the distributor pipe, a set of three valves connecting the vaporizers to the bottom regions of the three tanks, a set of three vent valves interposed between the vaporizers and the set of three valves and a set of three vent orifices connected to the set of three vent valves, whereby the opening of the vent valves allows the vaporizers to be cleared of the contaminants by flow of superheated vapor through the vaporizers.

* * * * *